United States Patent [19]

Kates

[11] 4,243,840

[45] Jan. 6, 1981

[54] LOUDSPEAKER SYSTEM

[75] Inventor: James M. Kates, Andover, Mass.

[73] Assignee: Teledyne Industries, Inc., Los Angeles, Calif.

[21] Appl. No.: 972,248

[22] Filed: Dec. 22, 1978

[51] Int. Cl.[3] ..... H04R 3/14

[52] U.S. Cl. ..... 179/1 D

[58] Field of Search ..... 179/1 D; 333/28 T, 132

[56] References Cited

U.S. PATENT DOCUMENTS

| | | | |
|---|---|---|---|
| 3,657,480 | 4/1972 | Cheng et al. | 179/1 D |
| 4,015,089 | 3/1977 | Ishii et al. | 179/1 D |
| 4,137,510 | 1/1979 | Iwahara | 333/132 |

OTHER PUBLICATIONS

H. Tremaine; Audio Cyclopedia; 1977; Library of Congress, Card Number 77-82885; pp. 351-352, pp. 1124-1126.

*Primary Examiner*—Raymond F. Cardillo, Jr.
*Assistant Examiner*—Randall P. Myers
*Attorney, Agent, or Firm*—Schiller and Pandiscio

[57] ABSTRACT

An improved loudspeaker system comprises an active crossover network for dividing the signal energy of an input audio signal into at least first and second frequency ranges separated by at least one frequency band, and at least a third frequency range including at least a part of the frequency band. The number of power amplifiers normally associated with a typical, similar powered loudspeaker system is reduced by combining the signal energy of the audio signal with at least the first and second frequency ranges so as to produce a first component signal and utilizing the signal energy in the third frequency range to form at least, in part, a second component signal. The system also comprises amplification means for independently amplifying the first component signal and the second component signal; means, including a passive crossover network, for dividing the signal energy of the amplified component signals into at least three output signals respectively including the signal energy in the three frequency ranges; and a plurality of speaker drivers connected, respectively, to be driven by the respective output signals.

12 Claims, 3 Drawing Figures

LOUDSPEAKER SYSTEM

The present invention relates generally to audio signal systems and more particularly to powered loudspeaker systems.

Typical loudspeaker systems include two or more different types of speakers or speaker drivers often within a single speaker enclosure. Many quality speaker drivers in these systems are designed to produce a sonic output signal over a preselected but limited range of frequencies in response to electrical input signals within a like range of frequencies. For example, in a typical three speaker system comprising woofer, mid-range and tweeter speakers, the woofer or low-range speaker might be designed to respond to signals below about 525 Hz, the mid-range speaker might be designed to respond to signals between about 525 Hz and 5000 Hz, and the tweeter or high-range speaker might be designed to respond to signals above about 5000 Hz.

The conventional or "passive" loudspeaker system also usually includes a single broadband amplifier, with the output of the amplifier being separated into plural frequency bands by a like number of filters of a "passive" crossover network. The number of filters of the passive crossover network correspond to the number of different speaker drivers being driven. The output of each filter is typically fed directly to the appropriate speaker driver.

A "powered" loudspeaker system, on the other hand, is generally one which has a plurality of power amplifiers often built directly into the loudspeaker enclosure. Typically, where the enclosure includes two or more different types of speaker drivers, one channel of amplification is provided for each type of loudspeaker driver within the enclosure, so that a two-way system would include two channels of amplification; a three-way system would include three channels of amplification and so on. The incoming audio signal is usually separated into two or more frequency bands by a like number of filters of an "active" crossover network. Each filter corresponds to the band pass of the respective speaker driver type with the output of each filter feeding its respective power amplifier, which in turn is connected to the appropriate speaker.

The primary function of both the active and passive crossover networks of these systems is to limit the frequency range of electrical signals presented to each driver. Signals too low in frequency from those frequencies for which the speaker driver is designed can cause excessive diaphragm displacement resulting in distortion and possible mechanical damage, and signals too high in frequency from those frequencies for which the speaker is designed may excite various resonant modes of the driver, causing distortion and inaccurate reproduction.

Generally, a powered loudspeaker system has several advantages over a conventional passive system. For example, power is normally dissipated in the passive crossover network of a conventional loudspeaker system. Since a powered loudspeaker does not require these passive components, it is as much as 1 to 2 dB more sensitive than a conventional loudspeaker system using the same identical drivers. A powered loudspeaker system is therefore more power efficient than a passive system.

Another advantage of the active network arises from the fact that the operation of a passive crossover network is affected by the characteristics of the drivers to which the network is connected. This makes passive crossover networks difficult to design and limits the quality of the final product. Since active crossovers are connected to amplifiers, not drivers, they are easier to design and simpler in their behavior.

Additionally, since passive crossover networks separate the electrical signals from a broadband amplifier into a plurality of frequency bands so as to drive the separate speaker drivers with frequency-limited signals, the passive networks must be designed so that the band pass edges of the individual filters have very steep slopes. The latter are necessary so as to (1) prevent loss of signal energy at the cutoff frequencies (at the bandedges) of the speaker drivers, and (2) prevent any one of the speakers, from being driven by signal energy at frequencies too high or too low from those frequencies for which the speaker is designed. Such passive networks having steep slopes at the bandedges, are however, relatively difficult and costly to design. Active crossover networks with very steep slopes at the bandedges, on the other hand, are relatively easier to design so that undesired output at the extremes of a driver's range can be greatly attenuated. For this reason a powered loudspeaker system will typically have lower distortion than a passive system designed around the same drivers.

Adjustment of an active crossover network for the exact response required is much easier than the corresponding adjustment of a passive crossover network. Crossover frequencies and stopband attenuation are readily modified, and compensation for the behavior of specific drive units can be designed into the active crossover network in a straightforward way. Active equalization to correct the overall system frequency response can also be added easily, by adjusting each crossover filter of the active network or by adding a broadband equalization network to the system. A powered loudspeaker system can have more uniform frequency response, or more accurate response to a given specification, than its passive counterpart.

A major disadvantage of a powered loudspeaker system, however, is the costs associated with plural power amplifiers built into the system. It is therefore desirable to provide a loudspeaker system that can provide the relative advantages of a powered loudspeaker system, e.g. greater power efficiency, lower distortion, and uniform frequency response, and at the same time reduce the costs associated with the use of plural amplifiers.

It is therefore a general object of the present invention to provide an improved loudspeaker system which overcomes the above-described disadvantages while retaining some of the advantages associated with both passive and active loudspeaker systems.

More specifically, objects of the present invention are to provide a loudspeaker system (1) having relatively greater power efficiency, lower distortion and substantially uniform frequency response than that normally associated with similar passive loudspeaker systems and (2) having the advantages of similar active loudspeaker systems but as reduced costs than those normally associated with such active systems.

These and other objects of the present invention are achieved by an improved loudspeaker system comprising a first filter network for dividing the signal energy of an input audio signal into at least two frequency ranges separated by at least one frequency band, and at least a third frequency range including at least a part of said frequency band; and means for summing at least the signal energy in the two frequency ranges to produce a first component signal, the signal energy in the third range forming at least a part of a second component signal. The system further comprises amplification means for independently amplifying the first component signal and the second component signal; means including a second filter network for dividing the signal energy of the amplified component signals into at least three output signals respectively including the signal energy in the three frequency ranges, and a plurality of speaker drivers connected respectively to be driven by the respective output signals.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims. For a fuller understanding of the nature and objects of the present invention, reference should be had to the following detailed description taken in combination with the accompanying drawings wherein:

In the drawings, the same numerals are used to designate like parts.

Figure 1:
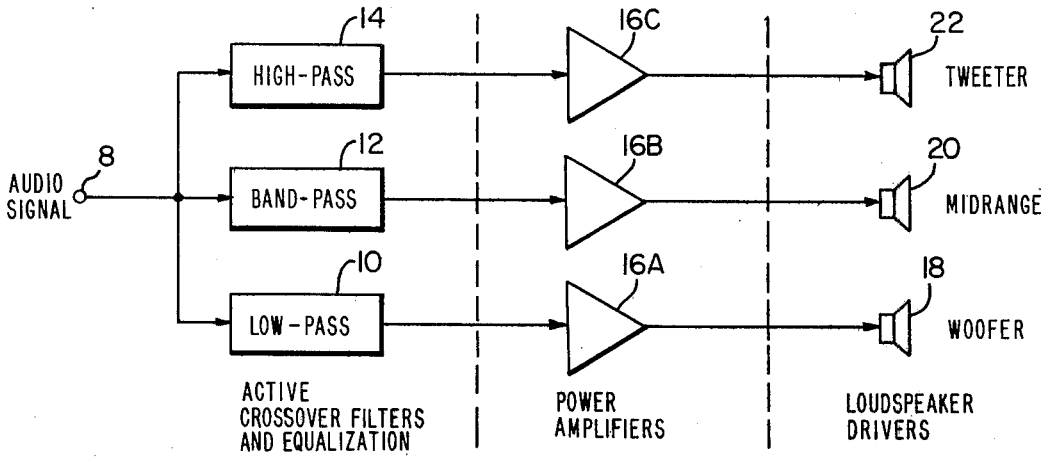
FIG. 1 PRIOR ART
FIG. 1 is a block diagram of a typical prior art powered loudspeaker system.

In FIG. 1 a typical three-way powered loudspeaker system is shown. The system includes an input terminal 8 for receiving an input audio signal and an active crossover network for separating the input audio signal into separate high-, mid-, and low-frequency bands. The network accordingly includes low-pass filter 10, bandpass filter 12 and high-pass filter 14. Each filter 10, 12 and 14 passes signal energy within a range of frequencies which corresponds to the bandpass of the corresponding low-, mid- and high-range speaker drivers indicated generally at 18, 20 and 22, respectively. The output of each filter 10, 12 and 14 is fed to a respective power amplifier 16A, 16B and 16C which in turn is respectively connected to the appropriate loudspeaker driver. Although, as described herein the powered loud speaker system has several advantages over a passive system, the use of an amplifier for each frequency channel increases the cost of the system. Accordingly, it is desirable to have a system that can provide the advantages of a powered loudspeaker system; i.e., greater efficiency, low distortion, and uniform frequency response; but utilizes a fewer number of amplifiers. Since typical powered loudspeaker systems employing active crossover networks use one power amplifier for each frequency channel, the present invention reduces the number of amplifiers by utilizing at least one of the amplifiers with at least two frequency channels.

More particularly, in accordance with the present invention, the system is designed so that the number of powered amplifiers of the active system is reduced by utilizing at least one of the amplifiers to amplify the combined signal energy in at least two frequency bands separated by one or more other bands. Means, preferably in the form of a passive network is utilized to separate the amplified signal containing the combined signal energy into the separate frequency bands corresponding to the bandpass of each speaker driver.

Figure 2:
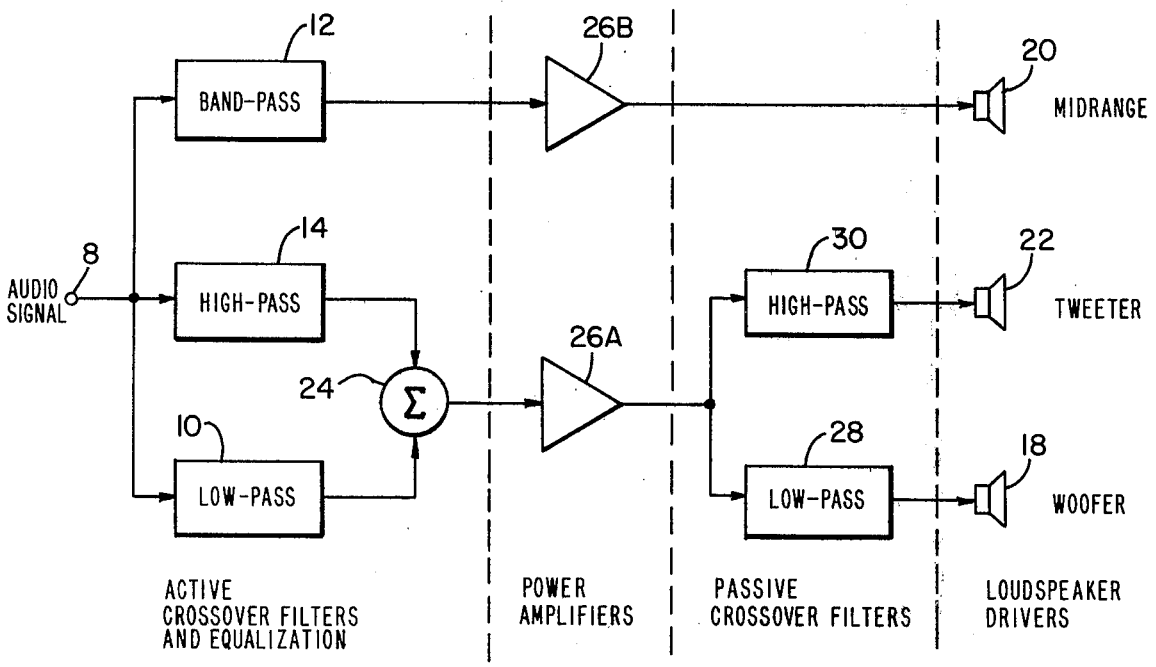
FIG. 2 is a block diagram of one embodiment of a loudspeaker system incorporating the principles of the present invention.

Referring to FIG. 2, a three speaker system, designed in accordance with the present invention, is shown as including an active crossover network which includes the low-pass filter 10, band-pass filter 12 and high-pass filter 14. In this instance the outputs of low-pass filter 10 and high-pass filter 14 are summed through summing means 24. The output of the latter is, in turn, applied to the input of amplifier 26A. Amplifier 26A is designed to have a good frequency response throughout and including the frequency ranges defined by the bandpass characteristics of filters 10 and 14. The output of bandpass filter 12 is applied to the input of amplifier 26B. The output of the latter is applied directly to the mid-range speaker driver 20. The output of amplifier 26A, however, is applied to a passive crossover network, comprising low-pass filter 28 and high-pass filter 30. The output of low-pass filter 28 is applied to low-frequency driver or woofer 18 and the output of high-pass filter is applied to high-frequency driver or tweeter 22.

In this FIG. 2 embodiment one amplifier 26B is used for the mid-range frequencies while the second amplifier 26A is used for both the woofer and tweeter speakers. As in FIG. 1 the active cross-over network divides the audio signal into three frequency bands. However, the high-pass and low-pass filter outputs are combined to produce a signal with the desired high frequency and low frequency content, but with no mid-range frequencies. This combined signal is then amplified by one power amplifier 26A. A passive crossover then separates the high and low frequencies, preventing the low frequency signal from reaching high frequency driver 22 and preventing high frequency signals from reaching the low frequency driver 18.

The passive crossover network in such a system can be designed simply. For example, where the crossover frequencies of the woofer, mid-range and tweeter speakers are respectively 525 Hz, 525 Hz and 5000 Hz, and 5000 Hz, high-pass filter 30 of the passive crossover network must allow frequencies of 5000 Hz and above to pass with a minimum of attenuation, while frequencies below 525 Hz must be greatly attenuated. It should be appreciated that even though the slopes of filters 28 and 30 at the cutoff frequencies 525 and 5000 Hz are not relatively steep and some signal energy between 525 and 5000 Hz can be passed by filters 28 and 30, this midrange frequency content will not be appreciable since the portion of the active crossover network comprising filters 10 and 14 will have greatly removed the energy in this frequency range because the slopes at the crossover frequencies 525 and 500 Hz, respectively of the filters 10 and 14 are relatively steep. Since most of the frequency content in the output of amplifier 26A is below 525 Hz and above 5000 Hz, low-pass filter 28 has to allow the signal energy at frequencies below 525 Hz to pass but to stop signal energy at frequencies above 5000 Hz, while high-pass filter 30 has to allow signal energy at frequencies above 5000 Hz to pass but stop signal energy at frequencies below 525 Hz. The design criteria of the passive crossover network which includes filters 28 and 30 are to minimize losses in the appropriate pass-band and to have adequate attenuation in the stop band. The purpose of the passive crossover network in the FIG. 2 embodiment is therefore to protect the woofer and the tweeter from energy outside the operating bandwidths.

The crossover deviation from the woofer to midrange drivers and from midrange to tweeter drivers is entirely controlled by the active crossover filters 10, 12 and 14. Adjustments made to the active high pass filter 14 will have no effect on the output of the woofer driver due to the action of the passive crossover network and due to the fact that a woofer can not produce extremely high frequencies. In turn, adjustments made to the active low pass filter should not effect the output of the tweeter speaker, because the action of the passive crossover network and because a tweeter can not produce low frequencies. In this embodiment the midrange speaker has its own filter 12 and amplifier 26B allowing separate adjustment of its frequency response. In this way, all of the flexibility and control of a three-amplifier, three-way system is retained in a two-amplifier three-way system.

The advantages of the powered loudspeaker system having one amplifier for each speaker driver are thus preserved in the embodiment of FIG. 2, together with a substantial economy. It should be appreciated that passive crossover losses are not significant in this configuration since crossover components can easily be chosen to minimize passband losses. Any response changes which result can be corrected by equalization in the active crossover network. Distortion is relatively low since the active crossover slopes can be made as steeply as necessary to exclude unwanted signal frequencies. In addition to the active crossover network, the woofer and tweeter ranges are also limited by the passive crossover slopes above and below the midrange. This combination can advantageously yield extremely steep slopes near the crossover frequencies.

It should be appreciated that the present invention can be utilized in systems using more than three different types of speaker drivers. For example, referring to FIG. 3, a four-way loudspeaker system design is shown incorporating the principles of the present invention. In this system four speakers 30, 32, 34 and 36 provide low frequency, lower mid-range frequency, upper mid-range frequency and high frequency outputs, respectively. Each speaker has a predetermined frequency response. The incoming audio signal to the system at input terminal 8 is divided by the active crossover filters into four bands corresponding to the frequency responses of the four speaker drivers. More specifically, the active crossover filters 38, 40, 42 and 44 respectively provide at their outputs, low frequency, lower band-pass, upper band-pass and high frequency signal energy contained in the input audio signal. Typical output-frequency ranges of such drivers might be up to 525 Hz for the woofer 30; 525–2000 Hz for lower midrange speaker 32; 2000–5000 Hz for upper midrange sepaker 34 and over 5000 Hz for tweeter 36. The output of low-pass and upper band-pass filters 38 and 42 are joined through the summing means 46A and provided to the input of amplifier 50A. The output of filters 40 and 44 are joined through summing means 46B and applied to the amplifier 50B. The outputs of amplifiers 50A and 50B are, in turn, applied to the inputs of the passive crossover filters, the latter providing select output signals corresponding to the band-pass characteristics of speakers 30, 32, 34 and 36. Specifically, the output of amplifier 50A which contains the low frequency and upper band-pass frequency signal energy is applied to passive low-pass filter 50 and high-pass filter 56. Passive low-pass filter 52 has a cut-off frequency at substantially the same frequency as the cut-off frequency of active low-pass filter 38. Similarly, the cut-off frequency of passive high-pass filter 56 has a cut-off frequency at substantially the same frequency as the lower cut-off frequency as the active upper band-pass filter 42. Thus, where low-pass filter 38 has a cut-off frequency of 525 Hz and upper band-pass filter 42 has a lower cut-off frequency of 2000 Hz, low pass filter 52 is designed to have a cut-off at 525 Hz and high-pass filter a cut-off at 2000 Hz. The output of filter 52 and 56 are accordingly applied to woofer 30 and upper midrange speaker 34, respectively. Similarly, the output of amplifier 50B is divided by the passive low-pass filter 54 and the high-pass filter 58. Passive low-pass filter 54 has a cut-off frequency at the upper cut-off frequency of lower band-pass filter 40 while passive high pass filter 58 has a cut-off at the same frequency as active high-pass filter 44. Thus, where lower band-pass filter 40 has an upper cut-off frequency at 2000 Hz, and active high pass filter 44 has a lower cut-off frequency at 5000 Hz, passive filters 54 and 58 will have similar cutoffs at 2000 and 5000 Hz. The outputs of filters 54 and 58 are applied to the respective drivers of speakers 32 and 36.

Figure 3:
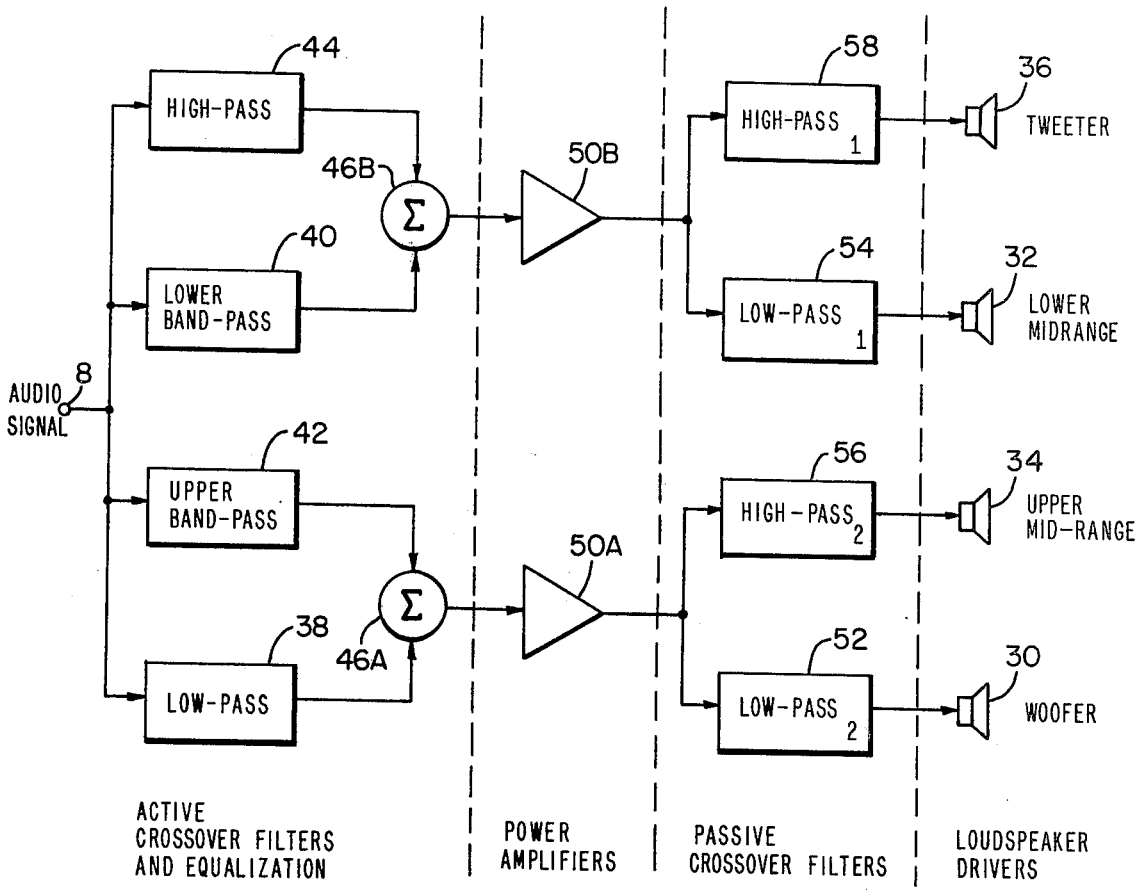
FIG. 3 is a block diagram of a second embodiment of a loudspeaker system incorporating the principles of the present invention.

In the FIG. 3 embodiment, the same design considerations enter into the design of the active network comprising filters 38, 40, 42 and 44 and the passive network comprising filters 52, 54, 56 and 58 as those previously described considerations with respect to the networks of the FIG. 2 embodiment. For example, the transmission characteristics of each of the filters 38, 40, 42 and 44 of the active network are designed to pass signal energy within the respective pass band with minimum attenuation, with relatively steep slopes at the cutoff frequency or frequencies, and attenuate the remaining signal energy outside the respective pass band. Thus, the signal at the output of summing means 46A will have most of the signal energy of that portion of the signal between the frequency pass bands of filters 38 and 42 attenuated, while the signal at the output of summing junction 46B will have most of the signal energy of that portion of the signal between the frequency pass bands of filters 50 and 44 attenuated. The crossover deviation from the woofer to the lower mid-range speaker, the lower mid-range speaker to the upper mid-range speaker, and the upper mid-range to the tweeter is thus controlled by the active crossover filters. The passive network comprising filters 52, 54, 56 and 58 minimize losses in the appropriate pass-band and have adequate attenuation in the stop band or bands. Adjustments made to the active filters 38, 40, 42 and 44 will thus have no effect on the respective speakers 34, 36, 30 and 32 due to the action of the passive network and due to the fact that woofer speaker 30 cannot produce the upper band-pass frequencies transmitted by upper band-pass filter 42; speaker 32 cannot produce the extremely high frequencies transmitted by high-pass filter 44; speaker 34 cannot produce low frequencies transmitted by low-pass filter 38; and speaker 36 cannot produce the lower band-pass frequencies transmitted by lower band-pass filter 40. Again the passive crossover losses are not significant in this configuration since crossover components can easily be chosen to minimize passband losses.

Other variations would allow for the midrange speaker of FIG. 2 to be replaced with upper midrange and lower midrange speaker drivers, such as those described in FIG. 3, connected through a conventional passive crossover network, or for any driver of FIGS. 2 and 3 to be replaced by two separate drivers connected through a passive crossover, without abandoning the principles of the present invention. Further, the present invention can be extended to systems using more than four drivers, utilizing two, three or more power amplifiers.

The present invention therefore retains substantially all the advantages of an active powered loudspeaker system, but by reducing the number of amplifiers reduces the relative costs of the system.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. A loudspeaker system comprising:

a first filter network for dividing the signal energy of an input audio signal into at least three frequency ranges, two of said frequency ranges being separated by at least the third frequency range;

means for summing at least the signal energy in said two frequency ranges so as to produce a first component signal, the signal energy in said third frequency range forming at least a part of a second component signal;

amplification means for independently amplifying said first component signal and said second component signal;

means including a second filter network for dividing the signal energy of the amplified component signals into at least three output signals, respectively including the signal energy in said frequency ranges; and a plurality of speaker drivers connected respectively to be driven by said output signals.

2. A loudspeaker system according to claim 1, wherein said first filter network is an active filter network.

3. A loudspeaker system according to claim 2, wherein said speaker drivers comprise woofer, midrange and tweeter speaker drivers, said active filter network includes an active low pass filter having band-pass characteristics defining a first of said two frequency ranges and an active high pass filter defining the second of said two frequency ranges, and an active band-pass filter having band-pass characteristics defining said third frequency range.

4. A loudspeaker system according to claim 3, wherein the bandpass characteristics of said active low-pass, active band-pass and active high-pass filters are substantially matched to the respective band-pass characteristics of said woofer, midrange and tweeter speaker drivers.

5. A loudspeaker system according to claim 3, wherein said second filter network is a passive filter network.

6. A loudspeaker system according to claim 5, wherein said passive filter network includes a passive low-pass filter having predetermined band-pass characteristics so as to pass substantially all of the signal energy passed by said active low-pass filter and attenuate substantially all of said signal energy passed by said active high-pass filter, and a passive high-pass filter having predetermined bandpass characteristics so as to pass substantially all of the signal energy passed by said active high-pass filter and attenuate subtantially all of said signal energy passed by said active low-pass filter.

7. A loudspeaker system according to claim 1, wherein said first filter network divides the signal energy of said input audio signal into at least four frequency ranges, with the first and second of said frequency ranges being separated by at least the third of said frequency ranges, and the third and fourth of said frequency ranges being separated by at least said second frequency range.

8. A loudspeaker system according to claim 7, wherein said speaker drivers comprise woofer, lower midrange, upper midrange and tweeter speaker drivers and said first filter network is an active filter network comprising an active low pass filter having band-pass characteristics defining said first frequency range, an active lower midrange filter having band-pass characteristics defining said third frequency range, an active upper-midrange filter having band-pass characteristics defining said second frequency range, and an active high pass filter having bandpass characteristics defining said fourth frequency range.

9. A loudspeaker system according to claim 8, wherein the bandpass characteristics of said active low-pass, active lower-midrange band-pass, active upper midrange band-pass and active high-pass filters are substantially matched to the respective bandpass characteristics of said woofer, lower-midrange, upper midrange and tweeter speaker drivers.

10. A loudspeaker system according to claim 8, wherein said second component signal includes the signal energy in said fourth frequency range.

11. A loudspeaker system according to claim 10, wherein said second filter network divides the signal energy of the amplified component signals into at least four output signals, respectively including the signal energy in said four frequency ranges.

12. A loudspeaker system according to claim 11, wherein said second filter network includes a first passive low pass filter and a first passive high pass filter connected to receive the first amplified component signal, and a second passive low pass filter and a second passive high pass filter connected to receive the second amplified component signal, said first passive low pass filter having predetermined bandpass characteristics so as to pass substantially all of the signal energy passed by said active low pass filter and to attenuate substantially all of the signal energy passed by said active upper band-pass filter, said first passive high pass filter having predetermined characteristics so as to pass substantially all of the signal energy passed by said active upper-band-pass filter and attenuate substantially all of the signal energy passed by said active low pass filter, said second passive low pass filter having predetermined bandpass characteristics so as to pass substantially all of the signal energy passed by said active low pass filter and attenuate substantially all of the signal energy passed by said active high pass filter and said second passive high pass filter having predetermined band pass characteristics so as to pass substantially all of the signal energy passed by said active high pass filter and to attenuate substantially all of said signal energy passed by said active lower band pass filter.

* * * * *